United States Patent [19]

Theewis et al.

[11] Patent Number: 4,815,146

[45] Date of Patent: Mar. 28, 1989

[54] CLOTHING ASSEMBLY

[75] Inventors: Simon R. Theewis, Zaadam; Robert J. E. V. Ebell, Oudendijk, both of Netherlands

[73] Assignee: Kraaijer Nederland B.V., Wormer, Netherlands

[21] Appl. No.: 72,358

[22] Filed: Jul. 13, 1987

[51] Int. Cl.[4] ..... A41D 13/00

[52] U.S. Cl. ..... 2/94; 2/244; 2/93; 2/2

[58] Field of Search ..... 2/244, 69, 2, 79, 81, 2/82, 85, 87, 93, 94, DIG. 11

[56] References Cited

U.S. PATENT DOCUMENTS

| | | | |
|---|---|---|---|
| 3,381,307 | 5/1968 | Shingler | 2/94 |
| 3,691,564 | 9/1972 | La Marre et al. | 2/81 X |
| 3,790,963 | 2/1974 | Ealy | 2/79 |
| 4,124,903 | 11/1978 | Shaw | 2/82 X |
| 4,211,261 | 7/1980 | Mehta et al. | 2/81 X |
| 4,253,198 | 3/1981 | Estabrook | 2/2 X |
| 4,365,354 | 12/1982 | Sullivan | 2/DIG. 11 X |
| 4,479,267 | 10/1984 | Radowsky | 2/2 |
| 4,625,337 | 12/1986 | Zahn | 2/94 X |

*Primary Examiner*—Werner H. Schroeder
*Assistant Examiner*—Jeanette E. Chapman
*Attorney, Agent, or Firm*—Lorusso & Loud

[57] ABSTRACT

The invention relates to a clothing assembly comprising a coat and trousers with reflecting strips. According to the invention the strips are applied in a special pattern, enlarging the recognition of the bearer of the clothing assembly as a human being.

18 Claims, 3 Drawing Sheets

CLOTHING ASSEMBLY

BACKGROUND OF THE INVENTION

The invention relates to a clothing assembly comprising a coat and trousers, provided with reflecting strips.

A clothing assembly of this type is used as working clothes for, among others, firemen and road workmen. With an appropriate choice of the locations where the reflecting on the working clothes, one tries to provide the working clothes with a notable appearance, especially under conditions of low visibility. While known working clothes are rather visible they cannot achieve a good identification of the wearer as a human being. Mostly an incoherent image is provided that hardly can be distinguished from the background, or which totally obscures what object, in this case a human being, it is.

It is an object of the invention to provide a clothing assembly of the type referred to above, removing this disadvantage in a simple, but nevertheless effective way.

SUMMARY OF THE INVENTION

Therefore the clothing assembly according to the invention is characterized by the reflecting strips on the forward coat tail and on the rearward coat tail that are applied in a closed pattern, each comprising an upper horizontal strip extending approximately at the height of the collar bones or the shoulder blades, respectively, a lower horizontal strip extending near to the lower edge of the coat section, wherein the lower horizontal strips on the forward coat tail and the rearward coat tail meet and two substantially vertical strips connecting said upper and lower strips and being positioned at some distance from each other. The upper horizontal strips meet strips applied to the sleeves and extending in the longitudinal direction thereof are, of the strips is applied to the forward sleeve tail and one to the rearward sleeve tail. Each trouser-leg comprises at its forward and its rearward side a strip extending in the longitudinal direction of said trouser-leg.

As a result of the position of the reflecting strips according to the invention a good recognizable human figure is always visible regardless of the position of the wearer or the direction from which one sees the wearer. Moreover the sleeves and the trouser-legs are provided with linear indications providing the volume-like indication of the torso.

According to a preferred embodiment of the clothing assembly the vertical strips are positioned more closely at the upper horizontal strip than at the lower horizontal strip. The natural line of the body is emphasized and the possibility is offered to carry a compressed air assembly without covering this section of the reflecting pattern.

Further it is preferred that the strips on the forward side of the trouser-legs are substantially aligned with the corresponding strips on the forward coat tail and extend outwardly of the knees, whereas the strips on the rearward side of the trouser-legs are inwardly disposed relative to the corresponding strips on the rearward coat tail and extend slightly inwardly of the hollow of the knees. In this way the trouser-legs comprise a simple linear indication in the form of two axial parallel lines. These lines are applied to each trouser-leg such that during a rotation at least one of said lines will always be visible. The schematic indication of a leg therefore will be maintained constantly. Further in applying the reflecting strip to the trouser-legs possible wear has been taken into account and the most heavily loaded locations, as on the knee and at the seat-bones of the pelvis, are spared.

Correspondingly it is possible, that the strips on the forward tail sleeves extend outwardly of the hollow of the arms and end slightly disposed upwardly relative to the corresponding upper horizontal strip of the forward coat tail, whereas the strips on the rearward tail sleeves extend slightly inwardly of the elbows and precisely join the corresponding upper horizontal strip of the rearward coat tail.

In determining the location of the strips on the sleeves similar considerations as with the trouser-legs are of importance. In all positions of the arms and as seen from all directions at least one linear indication of the arms should always be visible, the most heavily loaded locations on the elbows and at the inner sides of the sleeves have been spared.

According to a handy embodiment of the clothing assembly the horizontal strips of the coat tails have a larger width than the other strips. As a result the arms and legs are indicated as clearly smaller projections of a wider body.

Further the invention relates to a coat as applied in a clothing assembly according to the invention, as well as to trousers as applied in a clothing assembly according to the invention.

Hereafter the invention will be explained further with reference to the drawing in which an embodiment is illustrated of a clothing assembly according to the invention.

DESCRIPTION OF PREFERRED EMBODIMENTS

Figure 1:
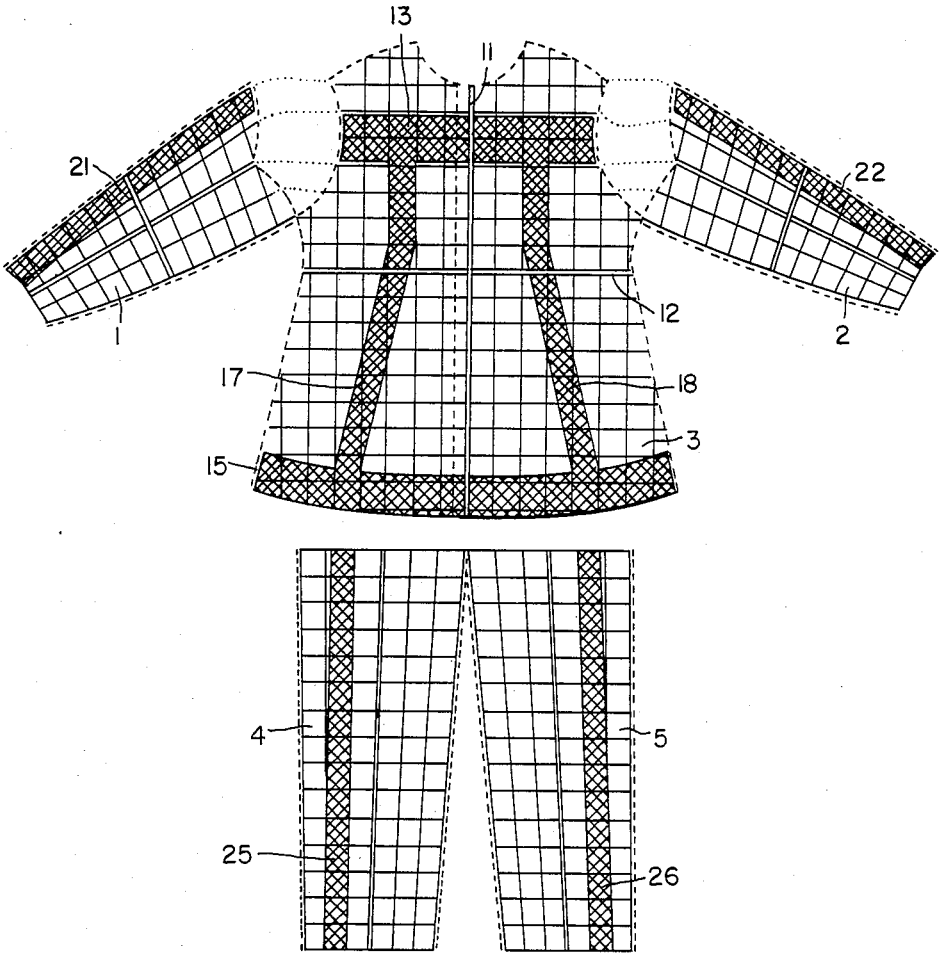
FIG. 1 illustrates a view of the assembling parts of the forward side of the clothing assembly according to the invention.
Figure 2:
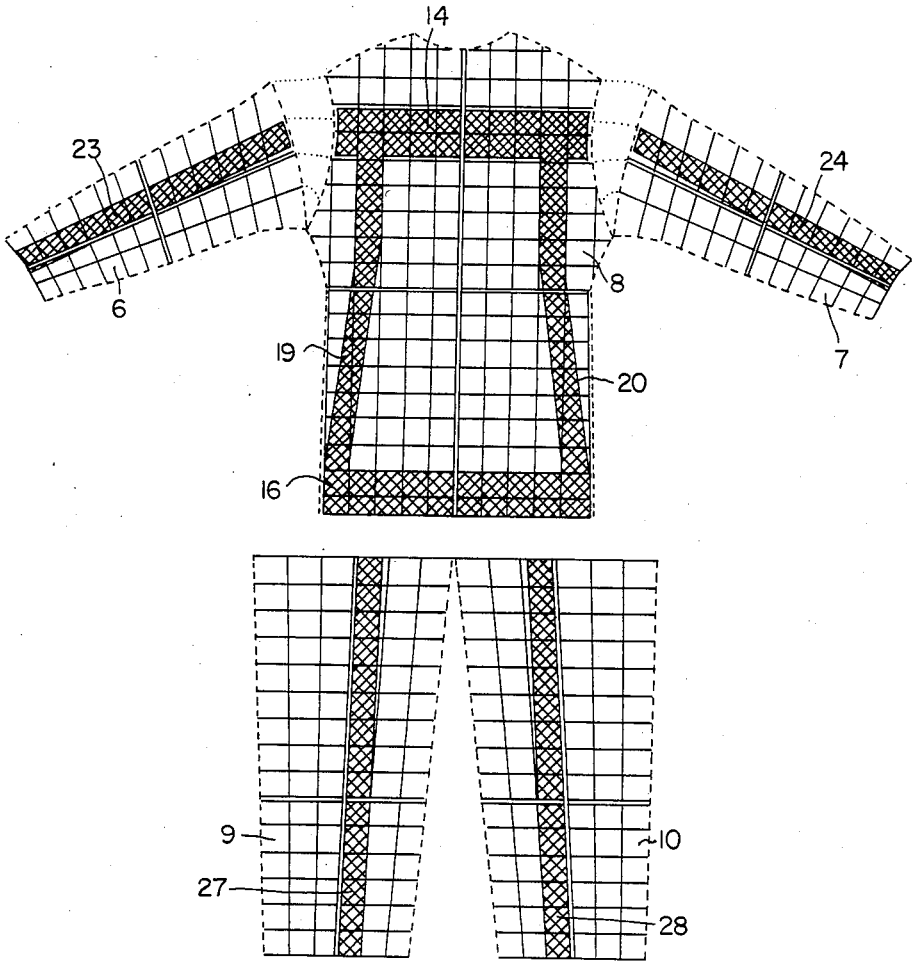
FIG. 2 illustrates a view of the assembling parts of the rearward side of the clothing assembly according to the invention.

FIGS. 1 and 2 show plans of the assembling parts of the clothing assembly. Accordingly FIG. 1 shows: the forward sleeve tails 1 and 2, the forward coat tail 3 as well as the forward tails 4, 5 of the trouser-legs.

Correspondingly FIG. 2 shows the rearward sleeve tails 6, 7, the rearward coat tail 8 as well as the rearward tails 9, 10 of the trouser-legs.

In a ready clothing assembly the forward sleeve tails 1, 2 are connected with the rearward sleeve tails 7 and 6, respectively, the forward coat tail 3 is connected with the rearward coat tail 8 and the forward tails 4, 5 of the trouser legs are connected with the rearward tails 10 and 9, respectively, of the trouser-legs. In FIGS. 1 and 2 the assembling lines are illustrated by fat dotted lines.

Further in FIGS. 1 and 2 the shown clothing assemblies are provided with a frame of reference made up of a large number of squares. This frame of reference only serves for determining the position of the reflecting strips on the clothing assembly, and in use it is not present. Further each of the assembling parts comprises two lines of reference, illustrated as full lines. Thus on the forward coat tail 3 the lines of reference 11 and 12 are applied. These lines of reference are meant for determining the position of the reflecting strips and are not present on a real clothing assembly.

As appears from FIGS. 1 and 2 the reflecting strips on the forward coat tail 3 as well as on the rearward coat tail 8 are applied in a closed pattern. Each closed pattern comprises an upper horizontal strip 13 and 14, respectively, a lower horizontal strip 15 and 16, respectively, and two substantially vertical strips 17, 18 and 19, 20, respectively, connecting the upper strips 13, 14 with the lower strips 15, 16 and being positioned at some distance from each other.

The upper horizontal strip 13 on the forward coat tail 3 extends substantially at the height of the collar bones of a bearer. The upper horizontal strip 14 on the rearward coat tail 8 extends substantially at the height of the shoulder blades of a bearer. The lower horizontal strips 15 and 16 extend near to the lower edge of the coat tails, wherein the horizontal strip 15 of the forward coat tail 3 meets the lower horizontal strip 16 of the rearward coat tail 8.

The upper horizontal strips 13 and 14 meet the forward sleeve tails 1, 2 and the rearward sleeve tails 6, 7, respectively. Onto the forward sleeve tails 1, 2 strips 21, 22 are applied, whereas onto the rearward sleeve tails 6, 7 strips 23, 24 are applied. As indicated in FIG. 1 by the shallow dotted lines between the forward sleeve tails 1, 2 and the forward coat tail 3 the strips 21, 22 on the forward sleeve tails 1, 2 end slightly disposed upwardly relative to the upper horizontal strip 13 of the forward coat tail 3. Correspondingly it appears from FIG. 2 that the strips 23, 24 on the rearward sleeve tails 6, 7 exactly join the upper horizontal strip 14 of the rearward coat tail 8.

As appears further from FIGS. 1 and 2 each trouser-leg comprises at its forward side (forward tails 4 and 5) as well as at its rearward side (rearward tails 9 and 10) strips 25, 26 and 27,28, respectively, extending in the longitudinal direction of the respective trouser-leg.

The vertical strips 17, 18 on the forward coat tail 3 and the vertical strips on the rearward coat tail 8 are positioned more closely at the respective upper horizontal strips 13 and 14 than at the respective lower horizontal strips 15 and 16. Each vertical strip 17-20 comprises an upper vertical section and a lower slightly inclined section, wherein the transition between said two sections is positioned approximately at the height of the lower side of the breast-bone of a bearer of the clothing assembly. The kinked structure obtained like this promotes the impression of the natural line of the body.

The strips 25, 26 on the forward side of the trouser-legs (on the forward tails 4, 5 of the trouser legs) are positioned substantially aligned with the vertical strips 17, 18 on the forward coat tail 3. The mentioned strips 25, 26 extend along the outer side of the knees of a bearer thus avoiding an excessive wear of these strips.

The reflecting strips 27, 28 on the rearward tails 9, 10 of the trouser-legs are disposed inwardly relative to the vertical strips 19 and 20 on the rearward coat tail 8 and extend slightly inwardly of the inner side of the hollow of the knees of a bearer. This appears in FIG. 2. The position of the reflecting strips 27, 28 is such that the most heavily loaded locations, where the seat-bones of the pelvis are positioned when sitting, are avoided.

The strips 21, 22 on the forward sleeve tails 1, 2 extend outwardly from the hollow of the arms of a bearer so that moving the sleeves along the body will not result in any wear of these strips 21, 22. Further the location of these strips 23, 24 on the rearward sleeve tails is chosen such that these extend slightly inwards of the elbows. Thus here too excessive wear at the elbows is avoided.

As appears clearly from FIGS. 1 and 2 the horizontal strips 13, 14 and 15, 16 of the forward coat tail and the rearward coat tail 8 have a larger width than all the other strips of the clothing assembly. In general the width of the said wider horizontal strips will be 8–9 cm whereas the width of the other strips is 5–6 cm. The arms and legs are indicated as clearly smaller projections of a wider body, promoting the recognition as a human being.

As can be seen too, the reflecting strips extend as far as the ends of the respective assembling parts of the clothing assembly, so that these reflecting strips provide reliable information about the dimensions of the limbs.

In positioning the reflecting strips on the forward coat tail 3 and the rearward coat tail 8 account is taken of carrying a compressed air assembly. Here, hiding the reflecting pattern because of covering the reflecting strips or because of folding the clothing assembly has been avoided.

Besides of the embodiment of the clothing assembly according to the invention shown in FIGS. 1 and 2 it is possible that the coat and trousers are integrally formed. In such an embodiment however the lower horizontal strips 15 and 16 will be positioned at the height of the upper legs of the wearer.

The FIGS. 3–9 show examples in practice of the images when a clothing assembly according to the invention is worn and reflects light falling theron. It is emphasized that the illustrations are represented in negative, this means that in reality the dark patterns have the largest brightness.

Figure 3:
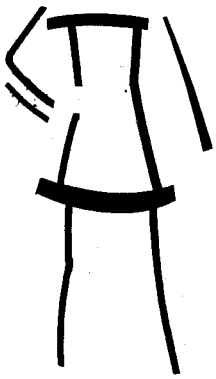
FIG. 3 illustrates the reflecting patterns of the clothing assembly from the front.
Figure 4:
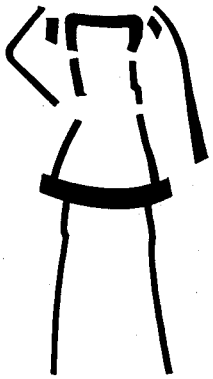
FIG. 4 illustrates the reflecting pattern of the clothing assembly from the front with the wearer carrying a compressed air assembly.
Figure 5:
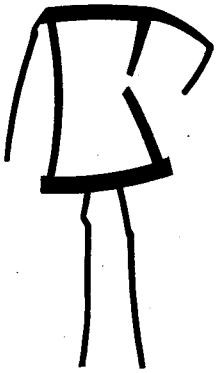
FIG. 5 illustrates the reflecting pattern of the clothing assembly from the rear.
Figure 6:
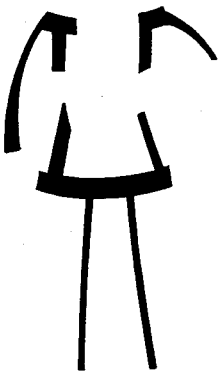
FIG. 6 illustrates the reflecting pattern of the clothing assembly from the rear with the wearer carrying a compressed air assembly.
Figure 7:
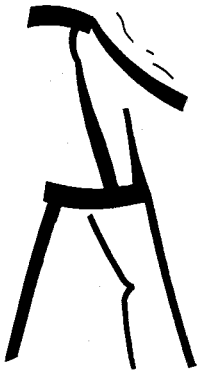
FIG. 7 illustrates the reflecting pattern of the clothing assembly from the rear in a walking position.
Figure 8:
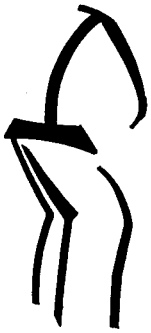
FIG. 8 illustrates the reflecting pattern of the clothing assembly from behind in a bent position.
Figure 9:
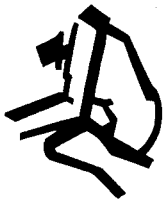
FIG. 9 illustrates the reflecting pattern of the clothing assembly from the left behind in a squatting position.

FIGS. 3 and 4 show a frontal view standing up, wherein FIG. 3 represents the situation without compressed air assembly and FIG. 4 represents the situation with compressed air assembly. Correspondingly FIG. 5 shows the situation without compressed air assembly as seen from the rear and standing up, whereas FIG. 6 represents a rearward view standing up with compressed air assembly. Further FIG. 7 shows from behind a walking position, FIG. 8 shows from right behind a bent position and finally FIG. 9 shows from left behind a squatted position. As appears from FIGS. 3-9, a human being is always clearly recognizable, thus enhancing the efficaciousness of the reflecting pattern.

The invention is not limited to the embodiment illustrated above, but can be varied widely within the scope of the invention.

What I claim is:

1. A clothing assembly comprising:

a coat having a front face and a rear face with reflecting strips secured on the front face such that there is a first upper horizontal strip extending at the height of the collar bones, a first lower horizontal strip extending near the lower edge of the front face, a right and a left substantially vertical front strip each connecting with the first upper and the first lower horizontal strips positioned at a distance from each other, and with reflecting strips secured on the rear face such that there is a second upper horizontal strip extending at the height of the shoulder blades, a second lower horizontal strip extending near the lower edge of the rear face connecting with the first lower horizontal strip, a left and a right vertical rear strip each connecting with the second upper and second lower horizontal strips positioned at a distance from each other;

a right sleeve attached to the coat having a front right sleeve reflecting strip secured to a front of the right sleeve extending longitudinally and a rear right sleeve reflecting strip secured to a rear of the right sleeve extending longitudinally;

a left sleeve attached to the coat having a front left sleeve reflecting strip secured to a front of the left sleeve extending longitudinally and a rear left sleeve reflecting strip secured to a rear of the left sleeve extending longitudinally;

trousers having a right and left leg, said right leg having a front right leg reflecting strip secured to a front face of the right leg extending longitudinally and a rear right leg reflecting strip secured to a rear face of the right leg extending longitudinally, said left leg having a front left leg reflecting strip secured to a front face of the left leg extending longitudinally and a rear left leg reflecting strip secured to a rear face of the left leg extending longitudinally.

2. The clothing assembly according to claim 1 wherein the right and the left substantially vertical front strips are positioned closer to each other at the first upper horizontal strip then at the first lower horizontal strip.

3. The clothing assembly according to claim 1 wherein the right and the left substantially vertical rear strips are positioned closer to each other at the second upper horizontal strip than at the second lower horizontal strip.

4. The clothing assembly according to claim 2 wherein the right and left vertical front strips comprise an upper vertical section and lower slightly inclined section wherein the transition between the upper and lower sections is approximately at the height of the lowerside of the breastbone.

5. The clothing assembly according to claim 3 wherein the right and the left vertical rear strips comprise an upper vertical section and lower slightly inclined section wherein the transition between the upper and lower sections is approximately at the height of the lowerside of the breastbone.

6. The clothing assembly according to claim 1 wherein the front right leg reflecting strip is positioned such that it lines up with the right front substantially vertical strip and the front right leg reflecting strip extends outward of the right knee, the front left leg reflecting strip is positioned such that it lines up with the front left substantially vertical strip and the front left leg reflecting strip extends outward of the left knee, the right rear leg reflecting is positioned slightly inward of the right rear substantially vertical strip and the rear right leg reflecting strip extends slightly inward of the hollow of the right knee, and the rear left leg reflecting strip is positioned slightly inward of the left rear substantially vertical strip and the rear left leg reflecting strip extends slightly inward of the hollow of the left knee.

7. The clothing assembly according to claim 1 wherein the front right sleeve reflecting strip extends outward of the hollow of the right elbow and ends slightly above the first upper horizontal reflecting strip, the front left sleeve reflecting strip extends outward of the hollow of the left elbow and ends slightly above the first upper horizontal reflecting strip, the rear right sleeve reflecting strip extends slightly inward of the right elbow and joins the second upper horizontal reflecting strip and, the rear left sleeve reflecting strip extends inward of the left elbow and joins the second upper horizontal reflecting strip.

8. The clothing assembly according to claim 1 wherein the first and second upper horizontal reflecting strips and the first and second lower horizontal reflecting strips are wider than any of the other strips.

9. The clothing assembly according to claim 8 wherein the width of the first and second upper horizontal strips and the first and second lower horizontal strips are approximately 8–9 cm in width while the other strips are 5–6 cm in width.

10. The clothing assembly according to claim 1 wherein the coat and trousers are integrally formed and the first and second lower horizontal reflecting strips are positioned approximately at the height of the upper legs.

11. The clothing assembly according to claim 2 wherein the coat and trousers are integrally formed and the first and second lower horizontal reflecting strips are positioned approximately at the height of the upper legs.

12. The clothing assembly according to claim 3 wherein the coat and trousers are integrally formed and the first and second lower horizontal reflecting strips are positioned approximately at the height of the upper legs.

13. The clothing assembly according to claim 4 wherein the coat and trousers are integrally joined and the first and second lower horizontal reflecting strips are positioned approximately at the height of the upper legs.

14. The clothing assembly according to claim 5 wherein the coat and trousers are integrally formed and the first and second lower horizontal reflecting strips are positioned approximately at the height of the upper legs.

15. The clothing assembly according to claim 6 wherein the coat and trousers are integrally formed and the first and second lower horizontal reflecting strips are positioned approximately at the height of the upper legs.

16. The clothing assembly according to claim 7 wherein the coat and trousers are integrally formed and the first and second lower horizontal reflecting strips are positioned approximately at the height of the upper legs.

17. The clothing assembly according to claim 8 wherein the coat and trousers are integrally formed and the first and second lower horizontal reflecting strips are positioned approximately at the height of the upper legs.

18. The clothing assembly according to claim 9 wherein the coat and trousers are integrally formed and the first and second lower horizontal reflecting strips are positioned approximately at the height of the upper legs.

* * * * *